US006854313B2

(12) United States Patent
Knudson et al.

(10) Patent No.: US 6,854,313 B2
(45) Date of Patent: Feb. 15, 2005

(54) TUBE CRIMPING/BENDING APPARATUS

(76) Inventors: Gary A. Knudson, 27795 County Rd. 14, Oak Creek, CO (US) 80467; Patrick D. Flood, 269 West Dr., Golden, CO (US) 80403

( * ) Notice: Subject to any disclaimer, the term of this patent is extended or adjusted under 35 U.S.C. 154(b) by 0 days.

(21) Appl. No.: 10/632,738

(22) Filed: Aug. 1, 2003

(65) Prior Publication Data

US 2004/0025559 A1 Feb. 12, 2004

Related U.S. Application Data

(60) Provisional application No. 60/401,369, filed on Aug. 6, 2002.

(51) Int. Cl.[7] ..... B21D 9/14
(52) U.S. Cl. ..... 72/307; 72/370.04
(58) Field of Search ..... 72/307, 400, 420, 72/370.19, 370.01, 370.04

(56) References Cited

U.S. PATENT DOCUMENTS 1,020,028 A * 3/1912 Dymond ..... 72/307
1,875,186 A * 8/1932 Tilp ..... 72/30.1
3,670,553 A 6/1972 Nothum et al.
3,861,184 A 1/1975 Knudson
4,198,842 A 4/1980 Pawlaczyk
5,836,194 A 11/1998 Micouleau et al.

* cited by examiner

*Primary Examiner*—Daniel C. Crane
(74) *Attorney, Agent, or Firm*—Ancel W. Lewis, Jr.

(57) ABSTRACT

Tube bending/crimping apparatus has a frame, a toggle assembly and a carriage assembly. The toggle assembly has overlapping male dies with tapering working tips that form a self-centering wedge. The carriage assembly has a shaft with a pinion that engages a rack on the frame to move the carriage assembly. A handle on the shaft is linked to the shaft by a cam clutch and a plunger, so that when the plunger is engaged, pushing the handle moves the carriage assembly forward. When the plunger is disengaged, the carriage assembly is easily moved back to the starting position. Mechanical stops for the handle assure consistent advancement. A receiving element on the carriage assembly has grooves for several sizes and orientations of tube.

9 Claims, 4 Drawing Sheets

TUBE CRIMPING/BENDING APPARATUS

This application claims the benefit under 35 U.S.C. § 119(e) of the U.S. provisional patent application No. 60/401,369 filed Aug. 6, 2002.

TECHNICAL FIELD

The present invention relates to sheetmetal forming apparatus and more particularly to apparatus that forms bends in rectangular tubing.

BACKGROUND ART

Rectangular tube is used, for example, in downspouts connected to rain gutters to selectively transport rain water downward. Such downspouts often bend inwardly to a building wall from the rain gutter at the eave, then bend downwardly to extend down the wall and then bend outwardly from the wall. Downspouts may require additional bends, as for example, when a lower portion of a wall juts out beyond an upper portion of the wall. It is generally possible to fashion most downspout systems from straight sections of tube combined with mass produced elbows. However, more reliable and esthetically pleasing systems can be built by custom bending tube on site.

Rectangular tube is typically bent by a plurality of spaced folds on three sides of the tube. Apparatus for creating the folds includes a female die with an annular groove inside the tube and a toggle assembly with male dies that crimp three sides of the tube into the annular groove. A carriage assembly pushes the tube, folding the crimped portion of tube in the annular groove to form the fold. The bend is formed by alternating crimping and advancing steps. Consistent, esthetic bends require uniform advancement of the carriage assembly between folds.

Examples of motorized bending apparatus are disclosed in U.S. Pat. No. 3,670,553 to Nothum et al. and U.S. Pat. No. 3,861,184 to Knudson. Nothum et al. uses a rotating cam and a ratchet mechanism with a rack on the carriage assembly to uniformly advance the tube. Knudson uses an eccentric roller, star follower and a pinion that engages a rack on the carriage assembly to uniformly advance the tube. Manually operated apparatus that is simpler and more portable may be more desirable than motorized apparatus for on site tube bending.

U.S. Pat. No. 4,198,842 to Pawlaczyk discloses a manually operated tube bending apparatus with a first handle actuating a toggle assembly and a second handle with a ratchet mechanism connected through a series of gears on the frame and a chain to actuate a carriage assembly. Pawlaczyk does not explicitly disclose any means for assuring uniform advancement of the tube and the second handle must be turned through several rotations to return the carriage assembly to the start position after a tube is bent. U.S. Pat. No. 5,836,194 to Micouleau et al. discloses a manually operated tube bending apparatus with a single handle actuating a toggle assembly and a carriage assembly. The carriage assembly is advanced by an advancing ratchet mechanism with a rack on the carriage assembly that is released when the carriage assembly reaches a forward limit.

Precise adjustment of the male dies relative to the female was required in the prior known tube bending/crimping apparatus. The rack on the carriage assemblies of Nothum et al., Knudson, and Micouleau et al. makes each carriage assembly relatively long and thereby the apparatus relatively long. Nothum et al., Knudson, and Pawlaczyk each use a mandrel on the carriage assembly that receives the end of a tube. Such mandrels have to be changed or adjusted for each different size and orientation of tube.

A simpler, more compact apparatus than the prior known apparatus would be easier to transport to a work site. Manual apparatus with a carriage assembly that advances a consistent distance and that can easily be moved back to the starting position without multiple turns of a handle is more efficient for an operator to use. A receiving element that receives several sizes and orientations of tube without change or adjustment is also desirable.

DISCLOSURE OF THE INVENTION

Tube crimping/bending apparatus includes a frame, a carriage assembly movably mounted on the frame, and a toggle assembly. The frame has a base, spaced front and rear plates extending up from the base, a rack connected to the rear plate and extending to the front plate, and a female die, with an annular groove, mounted on the front of the rack. The carriage assembly has a receiving element, a laterally extending carriage shaft carried by the receiving element, a carriage handle, a means for coupling the carriage handle to the carriage shaft, and means for limiting rotation of the carriage handle that provides uniform advancement. The receiving element has grooves that receive several sizes and orientations of tube. The rack extends through an aperture in the receiving element and engages a pinion on the carriage shaft. The means for coupling in a first configuration engages the carriage handle to the carriage shaft in one direction and releases the carriage shaft from the carriage handle in the other direction, and in a second configuration allows the carriage shaft to rotate freely in both directions relative to the carriage handle. The toggle assembly mounts on the front plate and includes a top toggle plate, opposed side toggle plates linked to the top toggle plate, a male die on each of the top and side toggle plates, and a toggle handle that actuates the top and side toggle plates to push the male dies into the annular groove of the female die. The male dies have overlapping working tips that taper to form a self-centering wedge.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
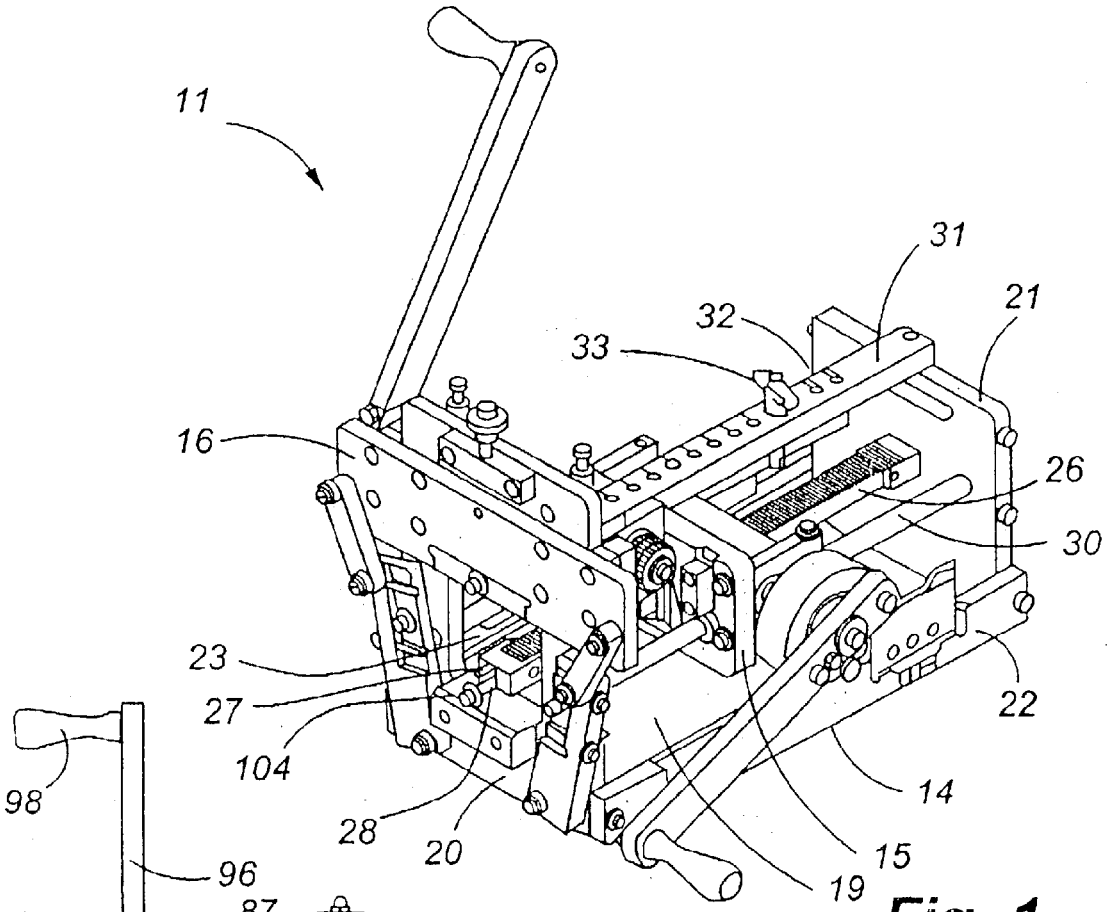
FIG. 1 is a perspective view of a tube crimping/bending apparatus embodying features of the present invention, with the dies removed.
Figure 2:
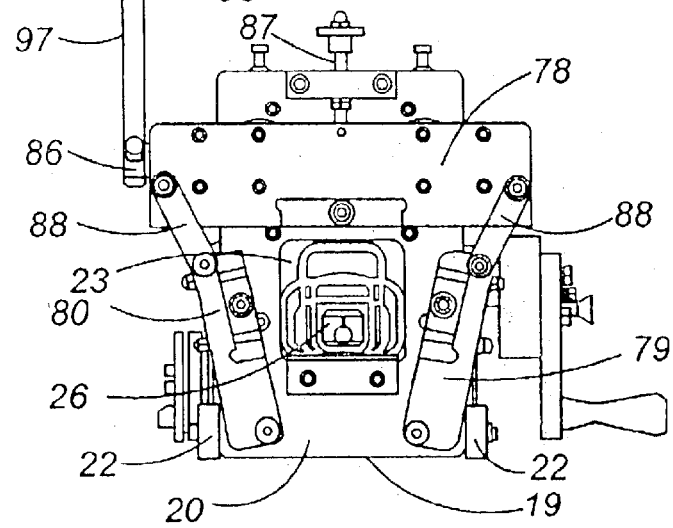
FIG. 2 is a front elevation view of the apparatus of FIG. 1.
Figure 3:
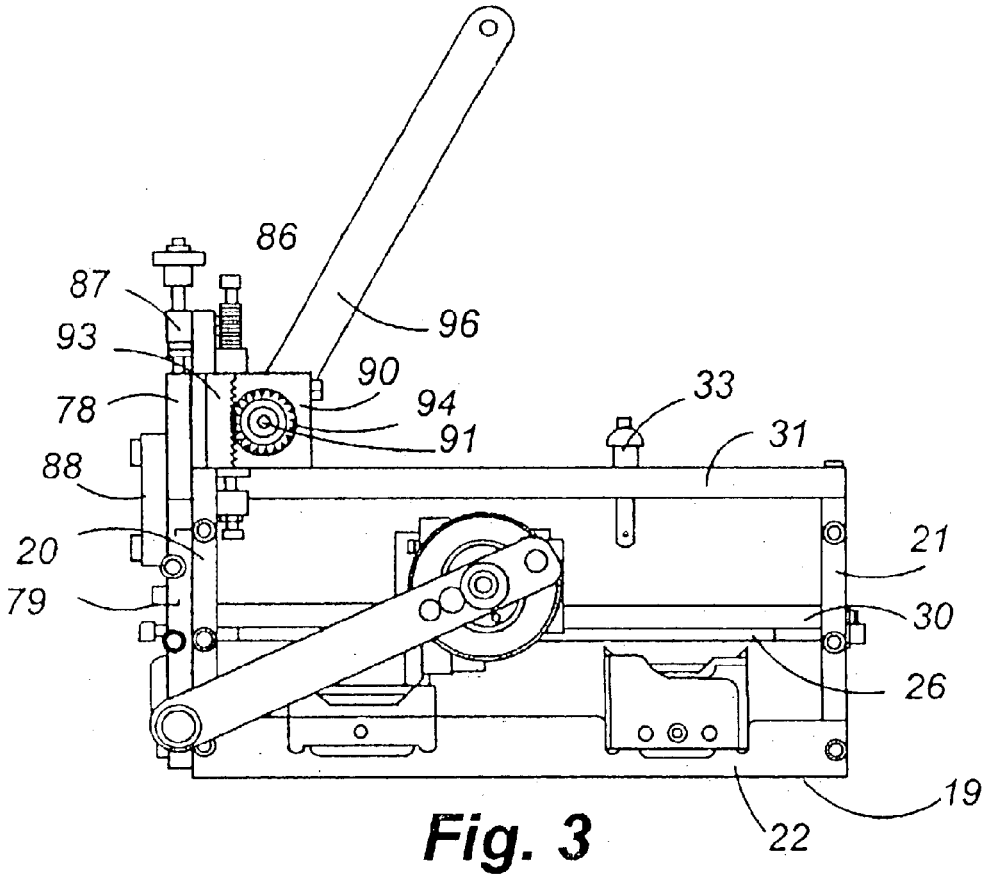
FIG. 3 is a view side elevation of the apparatus of FIG. 1.
Figure 4:
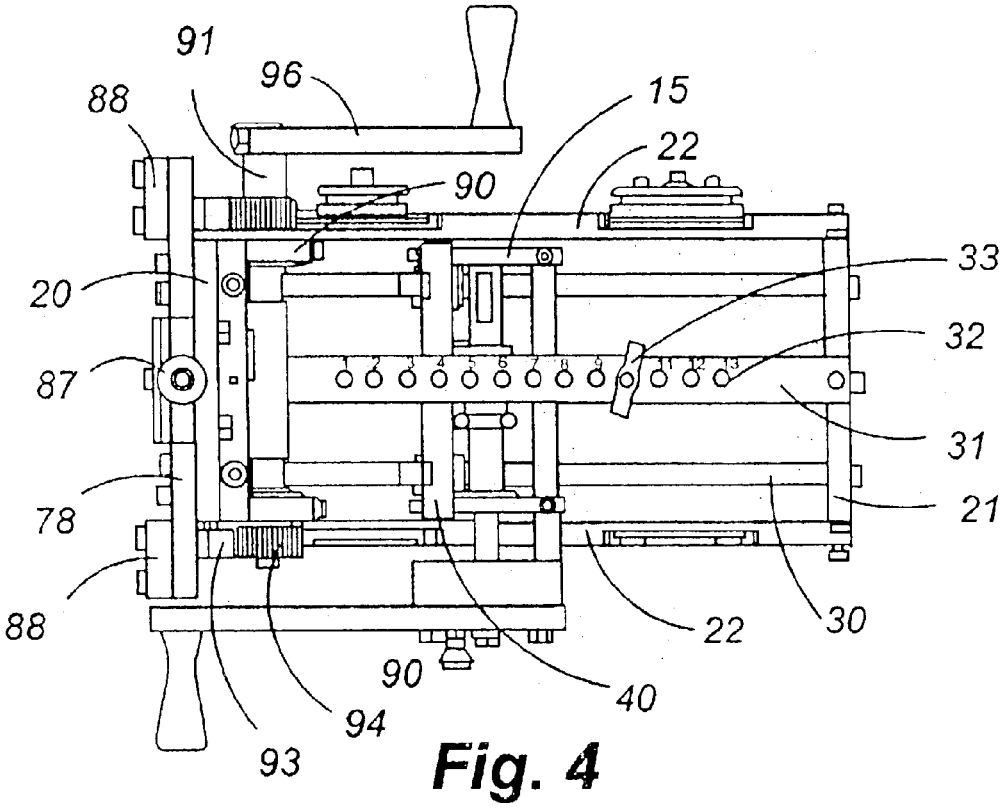
FIG. 4 is a top plan view of the apparatus of FIG. 1.

Referring to FIGS. 1 to 4, tube crimping/bending apparatus 11 embodying features of the present invention includes a frame 14, a carriage assembly 15 and a toggle assembly 16. The frame 11 has a rectangular, U shaped, sheet metal base 19, a substantially rectangular front plate 20 rigidly mounted on and extending upward from the front of the base 19, and a spaced, substantially rectangular back plate 21 rigidly mounted on and extending upward from the back of the base 19.

Describing the specific embodiments herein chosen for illustrating the invention, certain terminology is used which will be recognized as being employed for convenience and having no limiting significance. For example, the terms "front", "back", "right", "left" "vertical", "horizontal, "lateral", "longitudinal", "upper" and "lower" refer to the illustrated embodiment in its normal position of use. The terms "inward" and "outward" refer to directions toward and away from the geometric center of the apparatus. Further, all of the terminology above-defined includes derivatives of the word specifically mentioned and words of similar import.

Side plates 22 extend upward along opposite sides of the base 19 from the front plate 20 to the back plate 21. A rectangular tube opening 23, spaced above the base 19, extends through the front plate 20 and is sized to receive various sizes of tube. An elongated, toothed carriage rack 26 is affixed to the back plate 21 opposite the tube opening 23, and extends forwardly through the tube opening 23. A forwardly extending pin 27 and a threaded hole 28, below the pin 27, are provided on the front end of the carriage rack 26, for mounting a female die, as will be described hereinafter.

Parallel, spaced, horizontal support rods 30, on opposite sides of the carriage rack 26, extend between and are rigidly attached to the front and back plates 20 and 21. An elongated limit bar 31 is spaced above the carriage rack 26 and rigidly attaches at opposite ends to the front and back plates 20 and 21. A plurality of uniformly spaced limit holes 32 extend vertically through the limit bar 31. A limit pin 33 is provided that fits through the limit holes 32 and extends downward below the limit bar 31.

Figure 5:
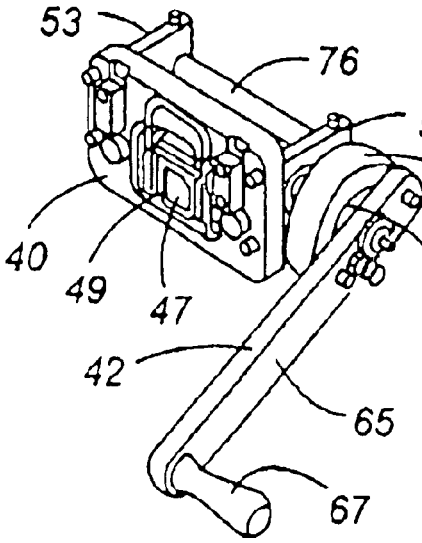
FIG. 5 is a front perspective view of the carriage assembly of the apparatus of FIG. 1.
Figure 6:
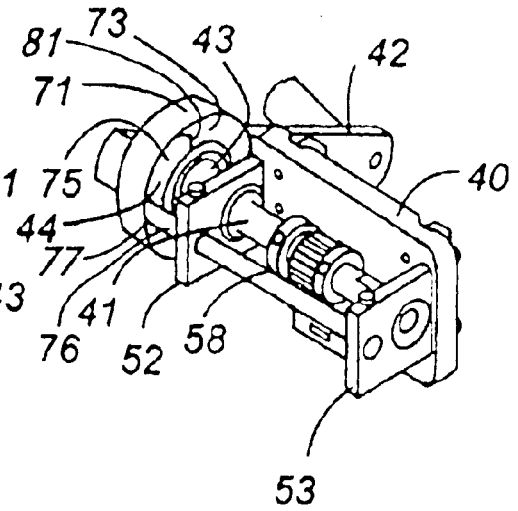
FIG. 6 is a rear perspective view of the carriage assembly of the apparatus of FIG. 1.
Figure 7:
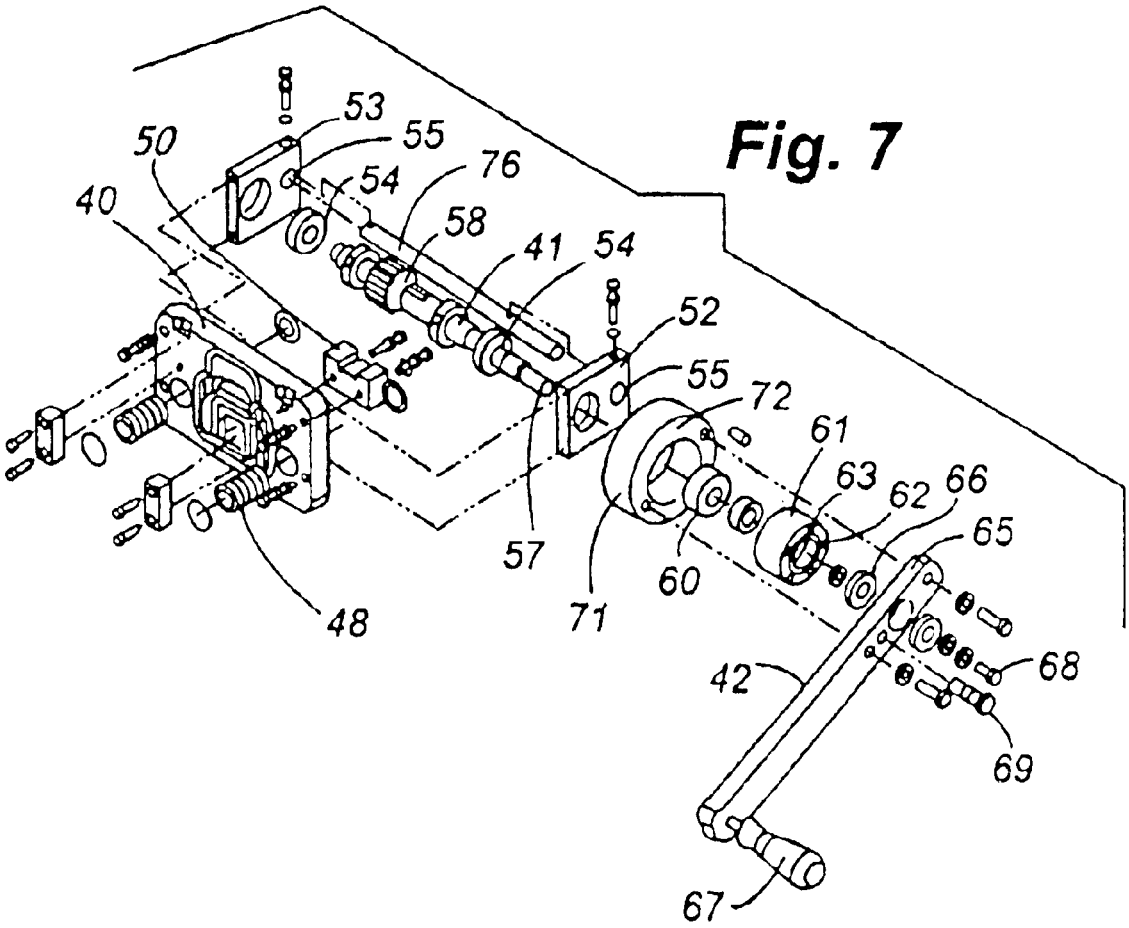
FIG. 7 is an exploded front perspective view of the carriage assembly of the apparatus of FIG. 1.
Figure 8:
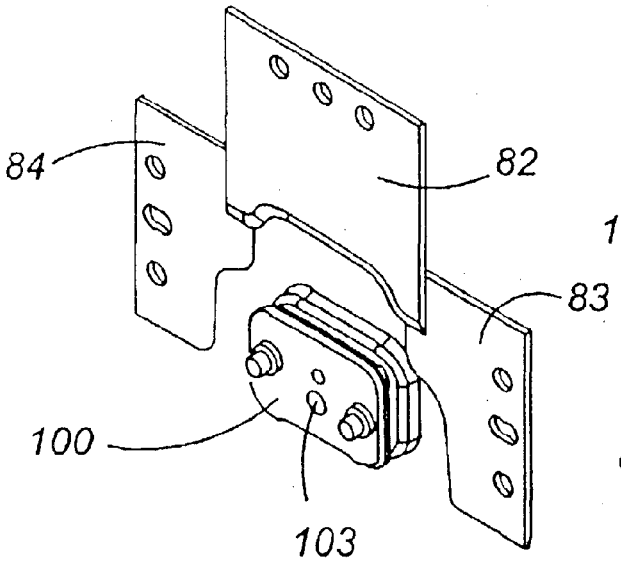
FIG. 8 is a perspective view of the dies of the apparatus of FIG. 1 in the open position.
Figure 9:
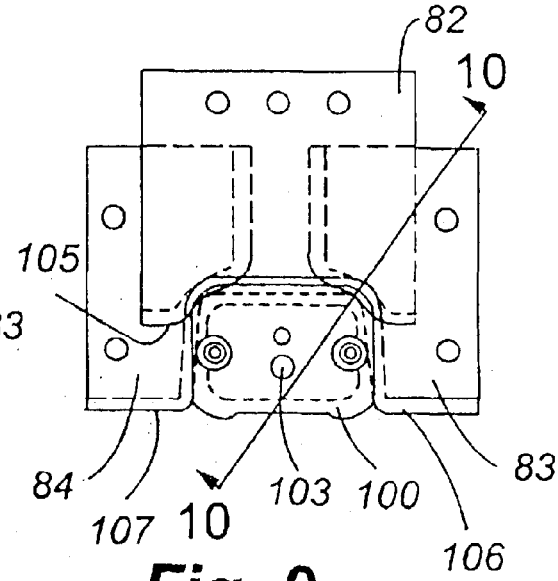
FIG. 9 is a front view of the dies of FIG. 8 in the closed position.
Figure 10:
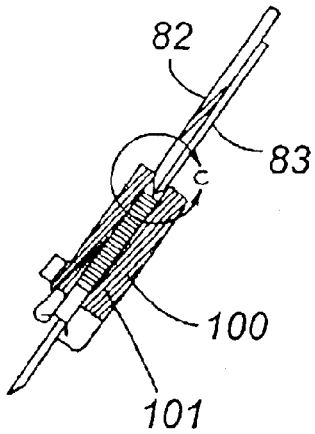
FIG. 10 is a sectional view taken along line 10—10 of FIG. 9.
Figure 11:
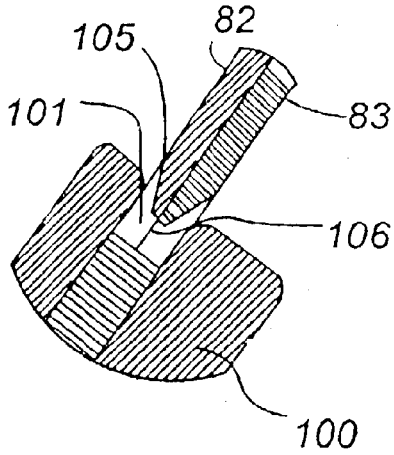
FIG. 11 is an enlarged partial view of FIG. 10.

The carriage assembly 15, as shown in FIGS. 5, 6 and 7, includes a receiving element 40, a carriage shaft 41, a carriage handle 42, a means for coupling 43, that couples the carriage handle 42 to the carriage shaft 41, and a means for limiting 44, that limits the stroke of the carriage handle 42. The receiving element 40 is a substantially rectangular, vertical plate. The receiving element 40 slidably mounts on the frame 14, under the limit bar 31, with the carriage rack 26 extending through a horizontal rack aperture 47 that extends through a lower middle portion of the receiving element 40, and the support rods 30 extending through linear bearings 48 that extend through the receiving element 40 on opposite sides of the rack aperture 47. A rack guide 50 rigidly mounts to the back of the receiving element 40 below the rack aperture 47.

A plurality of tube receiving grooves 49, sized and shaped to receive the ends of various sizes and orientations of rectangular tube, are cut into the front of the receiving element 40 around the rack aperture 47. Spaced, vertical, rearwardly extending right and left carriage side plates 52 and 53 rigidly attach to the back of the receiving element 40. Aligned carriage shaft bearings 54 extend through the right and left carriage side plates 52 and 53 and aligned stop rod apertures 55 extend through the right and left carriage side plates 52 and 53, rearward of the carriage shaft bearings 54.

The carriage shaft 41 rotably mounts in the two carriage shaft bearings 54 and extends rightwardly from the right carriage side plate 52 to a carriage shaft right end 57. A toothed carriage pinion 58 on the carriage shaft 41, between the right and left carriage side plates 52 and 53, is keyed or otherwise fixed on the carriage shaft 41 so that the carriage shaft and pinion 41 and 58 rotate together. The carriage pinion 58 is positioned to engage the carriage rack 26 so that when the carriage shaft 41 turns, the carriage assembly 15 moves forwardly or rearwardly on the frame 14.

A cam clutch 60 fits over the carriage shaft 41, between the right carriage side plate 52 and carriage shaft right end 57, engaging the carriage shaft 41 when turned in a counter-clockwise direction as viewed from the right side of the tube crimping/bending apparatus 11 while turning freely relative to the carriage shaft 41 when turned clockwise. A hollow, cylindrical cup 61 fits over and is keyed to the cam clutch 60, and has a right facing, annulus shaped cup face 62 with a plurality of spaced, radially arranged plunger holes 63 that extend into the cup 61.

The carriage handle 42 has a straight, elongated lever arm 65. A pair of opposed handle bearings 66 extend through the lever arm 65 near one end and a transversely extending hand grip 67 attached to the opposite end of the lever arm 65. The handle bearings 66 fit onto the carriage shaft 41, between the cup 61 and carriage shaft right end 57, so that the carriage handle 42 and carriage shaft 41 rotate freely relative to each other. The handle bearings 66 are secured on the carriage shaft 41 by a fastener 68 on the carriage shaft right end 57. A cylindrical plunger 69 slidably extends through the lever arm 65 near the handle bearings 66, and is sized and positioned to fit into the plunger holes 63, so that when the plunger 69 engages one of the plunger holes 63, rotation of the carriage handle 42 rotates the cup 61 and the cam clutch 60. The plunger 69 is biased leftward, toward the cup face 62, but can be pulled rightward, away from the cup face 62, to disengage or decouple the carriage handle 42 from the cam clutch 60.

A cylindrical ring 71 fits around the cup 61, between the right carriage side plate 52 and the lever arm 65, and rotates freely relative to the cup 61. The ring 71 has a right face 72 and a spaced left face 73, with the right face 72 being rigidly attached to the lever arm 65. A curved stop groove 75 of a selected length extends into the left face 73 and has a first end 77 and a spaced second end 81. A stop rod 76 extends through the stop rod apertures 55 of the right and left carriage side plates 52 and 53, and rightwardly from the right carriage side plate 52 into the stop groove 75, limiting rotation of the carriage handle 42 in the clockwise and counter-clockwise directions.

The means for coupling 43, in the illustrated embodiment, includes the cam clutch 60, cup 61, and plunger 69. When the plunger 69 is engaged, rotation of the carriage handle 42 in the counter-clockwise direction advances the carriage assembly 15 and the carriage handle 42 rotates freely relative to the carriage shaft 41 in the clockwise direction. When the plunger 69 is disengaged, the carriage assembly 15 is easily pushed rearward. Other suitable mechanisms for the means for coupling 43, may include, by way of example and not as a limitation, a ratchet and sliding gear. The means for limiting 44, in the illustrated embodiment, includes the stop rod 76 and the stop groove 75 in the ring 71. Other suitable means for limiting 44 may include, by way of example and not as a limitation, stop pins that directly engage the lever arm 65 at opposite ends of the desired stroke.

Referring again to FIGS. 1 to 4, the toggle assembly 16 includes a top toggle plate 78, right and left toggle plates 79 and 80, a top, right and left male dies 82, 83 and 84 mounted on the top, right and left toggle plates 78, 79 and 80, respectively, and a means for actuating 86, that actuates the top, right and left male dies 82, 83 and 84 to crimp a tube. The top toggle plate 78 mounts on the front of the front plate 20 of the frame 11, above the tube opening 23, in a vertically slidable fashion and is biased upward. The top toggle plate 78 has a laterally elongated, substantially rectangular shape, extending rightward and leftward of the front plate 20 of the frame 11. An adjustable upper stop 87, mounted on the front of the front plate 20 of the frame 11 above the top toggle plate 78 limits upward and downward movement of the top toggle plate.

The right and left toggle plates 79 and 80 are vertically elongated, substantially rectangular plates pivotally mounted at the lower ends to the lower end of the front plate 20 of the frame 11 on opposite sides of the tube opening 23. A pair of elongated spaced toggle links 88 pivotally attach to the top toggle plate 78, extend downwardly and inwardly, and pivotally attach, one each, near the upper ends of the right and left toggle plates 79 and 80, such that when the top toggle plate 78 moves downward the toggle links 88 pivot the right and left toggle plates 79 and 80 inward.

The means for actuating 86 includes a pair of spaced toggle side plates 90 rigidly mounted to the back of the front plate 20 of the frame 11, above the limit bar 31, and a rotably mounted toggle shaft 91 that extends laterally through the toggle side plates 90. A pair of spaced, vertical, toothed toggle racks 93 rigidly mount to the back of the top toggle plate 78 on opposite sides of the front plate 20 of the frame 11, and mesh with toggle pinions 94 that are rigidly attached to the toggle shaft 91. Other suitable means for actuating 86 may include a plunger and link arrangement. A toggle handle 96 includes an elongated lever arm 97 that attaches at one end to the left end of the toggle shaft 91 and has a laterally extending hand grip 98 attached to the opposite end.

Referring to FIGS. 7 to 10, the female die 100 is sized and shaped to fit into the tube selected to be bent, having a substantially rectangular frontal profile with radiused corners. The female die includes an annular groove 101 that extends around at least the top and both sides. An alignment aperture 102 and a fastening aperture 103, below the alignment aperture, each extend through the female die 100. The female die 100 fastens onto the front end of the carriage rack 26 with the pin 27 extending through the alignment aperture 102, and with a threaded fastener 104 extending through the fastening aperture 103 into the threaded hole 28.

The top, right and left male dies 82, 83 and 84 are each a substantially flat plate. The top, right and left male dies 82, 83 and 84 overlap when mounted in the top, right and left toggle plates 78, 79 and 80, with the right and left male dies 83 and 84 behind the top male die 82. The top male die 82 has a generally downward pointing working tip 105 shaped to crimp the top and upper corners of a tube, and sized and shaped to fit into the annular groove 101 of the female die 100. The right mail die 83 has a generally leftward pointing working tip, 106 shaped to crimp the right side and right upper corner of a tube, and sized and shaped to fit into the annular groove 101 of the female die 100. The left male dies 84 has a generally rightward pointing working tip 107 shaped to crimp the left side and left upper corner of a tube, and sized and shaped to fit into the annular groove 101 of the female die 100. The working tip 105 of the top male die 82 tapers rearwardly while the working tips 106 and 107 of the right and left male dies 83 and 84 taper forwardly so that the overlapping portions form a wedge that self-centers the top, right and left male dies 82, 83 and 84 in the annular groove 101 of the female die 100.

Operation of the apparatus 11 commences with selection and mounting of the correct female die 100 and top, right and left male dies 82, 83 and 84 for the size and orientation of the selected tube. The limit pin 33 is inserted into the limit hole 32 in limit bar 31 corresponding to the selected number of folds. The cylindrical plunger 69 on the carriage handle 42 is pulled out and the carriage assembly 15 is pushed back until the limit pin 33 stops the receiving element 40. A tube is inserted into the tube opening 23, around the female die 100, and into the receiving groove 49 on the receiving element 40. The cylindrical plunger 69 on the carriage handle 42 is released into one of the plunger holes 63 of the cup 61 to couple the carriage handle 42 to the cam clutch 60, so that actuation of the carriage handle 42 will advance the tube. The toggle handle 96 and the carriage handle 42 are pulled alternately, crimping then advancing and folding the tube, until the receiving element 40 reaches the front plate 20 of the frame 14 to form a plurality of folds and thereby a bend in the tube.

The above described tube crimping/bending apparatus 11, with the carriage rack 26 attached to the frame 14 and the carriage pinion 58 on the carriage assembly 15, is compact and mechanically simple. The means coupling 43 makes operation easy and the means for limiting 44 assures consistent folds. The receiving grooves 49 on the receiving element 40 eliminate the need to change mandrels. The overlapping, tapered, self-centering working tips 105, 106 and 107 of the top, right and left male dies 82 minimize the need for precise adjustment of the male dies.

Although the present invention has been described with a certain degree of particularity, it is understood that the present disclosure has been made by way of example and that changes in details of structure may be made without departing from the spirit thereof.

What is claimed is:

1. Apparatus for crimping/bending a tube comprising:

a frame including a female die, a toggle assembly mounted on said frame and having male dies that, in cooperation with said female die, crimp said tube, and a carriage assembly having a receiving element slidably mounted on said frame, a carriage shaft carried on said receiving element and engaging said frame to move said carriage assembly relative to said frame, a carriage handle rotably mounted on said carriage shaft and means for coupling said carriage handle to said carriage shaft, said means for coupling having a first configuration wherein said carriage handle engages and turns said carriage shaft when turned in a first direction and rotates freely relative to said carriage shaft when turned in an opposite second direction, and a second configuration wherein said carriage handle rotates freely relative to said carriage shaft in both directions, whereby said toggle and carriage assemblies are actuated alternately, crimping then advancing and folding said tube, to a plurality of folds in said tube, thereby bending said tube.

2. Apparatus as set forth in claim 1 wherein said means for coupling includes a cam clutch, mounted on said carriage shaft, that engages and turns said carriage shaft when turned in said first direction and rotates freely relative to said carriage shaft when turned in said second direction.

3. Apparatus as set forth in claim 2 wherein said means for coupling includes a plunger slidably mounted on said carriage handle, said plunger engaging said cam clutch in a first position and slidably moving to a second position and disengaging said cam clutch in said second position.

4. Apparatus as set forth in claim 1 wherein said carriage assembly includes a means for limiting the rotation of the carriage handle.

5. Apparatus as set forth in claim 4 wherein said means for limiting includes a ring attached to said carriage handle and having a stop groove, and a stop rod carried on said receiving element and extending into said stop groove, so that said stop rod limits rotation of said carriage handle at opposite ends of said groove.

6. Apparatus as set forth in claim 1 wherein said frame includes a toothed rack and said carriage shaft includes a toothed carriage pinion that engages said rack so that when said carriage shaft rotates said carriage assembly moves relative to said frame.

7. Apparatus as set forth in claim 1 wherein:

said female die includes an annular groove, said male dies include a top, right and left male die, said top male die overlaps said right male die and said left male die, and said top male die has a working tip that tapers towards said right and left male dies and said right and left male dies each have a working tip that tapers toward said top male die, whereby said working tips of said top, right and left male dies form a wedge that self-centers said working tips of said top, right and left male dies in said annular groove of said female die.

8. Apparatus as set forth in claim 1 wherein said receiving element includes a plurality of tube receiving grooves sized and shaped to receive a plurality of tube sizes and orientations.

9. Apparatus for crimping/bending a tube comprising:

a frame including a toothed rack, and a female die mounted on an end of said toothed rack and having an annular groove, a toggle assembly mounted on said frame and having top, left and right male dies that, in cooperation with said female die, crimp said tube, said top male die overlapping said right male die and said left male die, said top male die having a working tip that tapers towards said right and left male dies and said right and left male dies each having a working tip that tapers toward said top male die, whereby said working tips of said top, right and left male dies form a wedge that self-centers said working tips of said top, right and left male dies in said annular groove of said female die, and a carriage assembly having a receiving element slidably mounted on said frame, a carriage shaft carried on said receiving element and having a pinion that engages said rack to move said carriage assembly relative to said frame, a carriage handle rotably mounted on said carriage shaft, a cam clutch mounted on said carriage shaft that engages and turns said carriage shaft when turned in a first direction and rotates freely relative to said carriage shaft when turned in a second direction, a plunger slidably mounted on said carriage handle that engages said cam clutch in a first position and slidably moves to a second position and disengages said cam clutch in said second position, a ring attached to said carriage handle and having a stop groove, and a stop rod carried on said receiving element, extending into said stop groove, and limiting rotation of said carriage handle at opposite ends of said groove, said receiving element including a plurality of tube receiving grooves sized and shaped to receive a plurality of tube sizes and orientations, whereby said toggle and carriage assemblies are actuated alternately, crimping then advancing and folding said tube, to a plurality of folds in said tube, thereby bending said tube.

* * * * *